United States Patent [19]

Bessinger

[11] Patent Number: 4,733,843

[45] Date of Patent: Mar. 29, 1988

[54] FLEXIBLE GLASS SHELF BRACKET

[75] Inventor: Walter L. Bessinger, Grand Haven, Mich.

[73] Assignee: Knape & Vogt Manufacturing Company, Grand Rapids, Mich.

[21] Appl. No.: 29,238

[22] Filed: Mar. 23, 1987

[51] Int. Cl.[4] ..... A47G 29/02

[52] U.S. Cl. ..... 248/250; 108/152; 211/90

[58] Field of Search ..... 248/235, 250; 211/90; 108/152, 27, 28; 312/128

[56] References Cited

U.S. PATENT DOCUMENTS

| | | | |
|---|---|---|---|
| 564,519 | 7/1896 | Heysinger | 108/152 X |
| 883,323 | 3/1908 | MacDuff | 211/90 X |
| 1,789,815 | 1/1931 | Hanley | 248/231.7 |
| 2,477,771 | 8/1949 | Sanford | 248/250 X |
| 3,034,757 | 5/1962 | Suben . | |
| 3,666,228 | 5/1972 | Arnold | 248/250 |
| 4,375,565 | 5/1983 | Roberts et al. . | |
| 4,508,301 | 4/1985 | Nicholson et al. . | |

FOREIGN PATENT DOCUMENTS

| | | | |
|---|---|---|---|
| 811370 | 8/1951 | Fed. Rep. of Germany . | |
| 1534774 | 1/1963 | Fed. Rep. of Germany . | |
| 1400793 | 7/1969 | Fed. Rep. of Germany . | |
| 2749477 | 5/1979 | Fed. Rep. of Germany . | |
| 258041 | 9/1926 | United Kingdom | 211/90 |
| 2155310 | 9/1985 | United Kingdom . | |

*Primary Examiner*—J. Franklin Foss

*Attorney, Agent, or Firm*—Price, Heneveld, Cooper, DeWitt & Litton

[57] ABSTRACT

A support bracket for a glass or marble shelf panel has a laterally oriented receiving throat defined by an upper support member and a lower support member, both extending horizontally from a vertical wall mounting plate. One of the support members is flexibly joined to the mounting plate by a reduced thickness portion and the other support member is rigidly joined to the mounting plate. Adjusting means rotate the movable support member so that the shelf panel is grasped between the two support members.

14 Claims, 3 Drawing Figures

FLEXIBLE GLASS SHELF BRACKET

BACKGROUND OF THE INVENTION

This invention relates to shelf support brackets and in particular to brackets of the type that support glass and marble shelf panels in a cantilever fashion.

Cantilever shelf brackets for supporting inserted shelf panels, usually of wood, have been known for many years. In recent years, these have taken the form of extruded aluminum devices capable of receiving the shelf in a wedging action, as in U.S. Pat. Nos. 4,508,301 and 4,385,565. That is, the wood shelf panel of closely controlled thickness tolerance is placed under slightly deformed wedging stress during insertion for secure retention of the assembled panel structure. While this works very well for certain materials such as wood or particle board, it is not desirable to apply such stresses to certain other materials, particularly glass or marble. Breakage can result. This potential breakage problem is accentuated by the fact that glass panels for shelving tend to vary considerably in thickness. Therefore, a thicker panel either will not fit within the throat of the bracket, or, if sufficient force is applied to wedge it in place, the stress is immediately too great. If a thin panel is inserted, it is not securely retained.

SUMMARY OF THE INVENTION

A primary object of this invention is to provide a cantilever shelf bracket capable of receiving and retaining a shelf panel of glass or marble without scratching, marring or application of localized stress to the panel upon assembly. An additional object is to provide such a shelf bracket that is simple in construction. The support bracket has a laterally oriented receiving throat defined by an upper support member and a lower support member both extending longitudinally from a vertical wall mounting plate. One of the support members is attached to the mounting plate by hinge means, such as a reduced thickness portion, to allow limited rotational movement about a horizontal axis. The other support member is rigidly attached to the mounting plate. Adjusting means are provided for rotating the movable support member so that the glass panel is grasped between the two support members. The support bracket that forms the basis of this invention is essentially formed of a single extruded aluminum member with only miscellaneous hardware pieces added and is therefore extremely simple of design.

These and other related objects, advantages and features of this invention will become apparent upon review of the following specification in conjunction with the drawings.

DESCRIPTION OF THE PREFERRED EMBODIMENT

Figure 1:
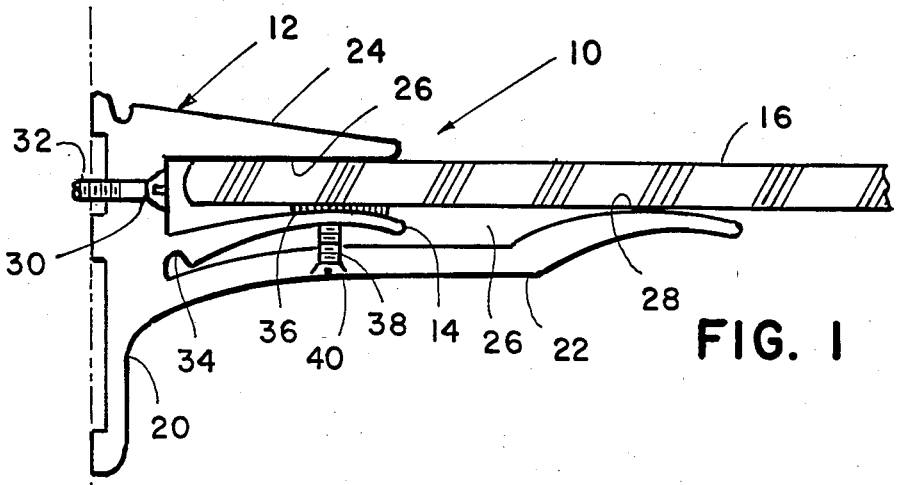
FIG. 1 is a side elevational sectional view of the bracket assembly according to the invention retaining a glass shelf panel.

Referring now specifically to the drawings, and the illustrative embodiments depicted therein, the shelf bracket assembly 10 includes a bracket assembly 12 preferably comprising an elongated metal member formed as by extrusion of aluminum. Bracket assembly 12 has a throat 26 to receive the rear portion of a shelf panel 16. Throat 26 is defined by an upper support member 24, a lower support platform 22 and a vertical rear panel 20. The bracket assembly is attached to a vertical wall by fasteners such as screws 32 penetrating orifice 30 and extending into studs within the wall. Lower support platform 22 is generally horizontal and rigidly affixed to vertical rear plate 20. An outward portion of support platform 22 extends upwardly and curves downwardly to form a outer support surface 28 and a depression or recess 26 between this surface and rear panel 20. A glass panel 16 that is inserted into the bracket assembly 12, only a portion of which is shown in the drawings, will be supported within the assembly by outer support surface 28 on the bottom and an upper support surface 25 of support member 24 on the top. However, a shelf so supported may be subject to disruption upon being contacted or pulled from the throat area.

To provide additional stability for the shelf and retention within the throat, a movable jaw, or lower support member, 14 is provided in the throat area between upper support member 24 and lower support platform 22. Lower support member 14 is integrally joined to vertical rear panel 20 by a reduced thickness neck portion 34. Neck portion 34 allows limited vertical flexibility in a rotary motion of support member 14 about a horizontal transverse axis. An adjustment screw 40 is longitudinally, threadably adjustable by mounting within a threaded aperture 38 in lower support platform 22. A compression pad 36, formed from a resilient polymeric material, such as polyvinylchloride, is attached to an upper surface of lower support member 24.

In order to support a shelf panel 16, the bracket assembly 12 is first affixed to a vertical wall in a horizontal orientation. Adjustment screw 40 is adjusted downwardly allowing lower support member 14 to rotate downwardly. The rear portion of a shelf panel 16 is then inserted between upper support and lower support members 24, 14 until the rear edge of the shelf panel almost touches the vertical rear panel 20. The shelf panel will be supported between surfaces 25 and 28. The adjustment screw 40 is rotated bringing lower support member 14 into contact with shelf panel 16. The adjustment screw is additionally rotated until sufficient force between support members 14, 24 prevent the shelf from pulling from the throat 26.

Figure 2:
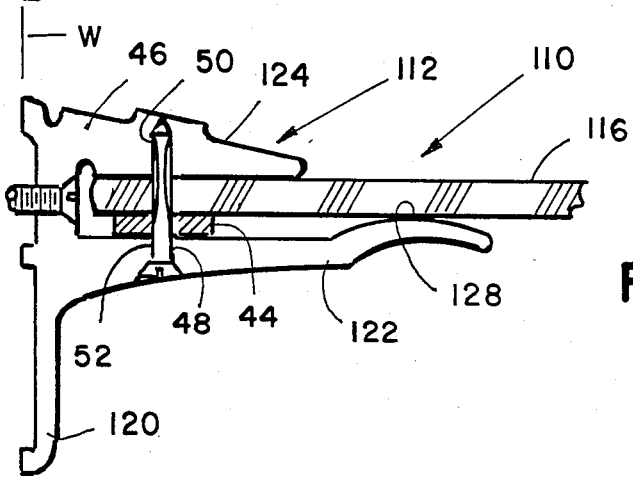
FIG. 2 is the same as FIG. 1 except of an alternative embodiment of the invention.

An alternative, but not necessarily preferred, embodiment is shown in FIG. 2. In this embodiment, upper support member 124 is integrally joined to vertical rear panel 120 by a reduced thickness neck portion 46. Upper support member 124 is therefore provided with limited vertical flexibility in a rotational movement about a horizontal transverse axis. A lower support platform 122 is rigidly attached to vertical rear panel 120 and terminates in a upwardly extending, downwardly curved outer support surface 128. Threaded adjustment screw 52 extends through a clearance hole 48 in lower support platform 122 and is threadably received in threaded blind hole 50 in upper support member 124. A resilient compression pad 44 is provided on lower support platform 122. A shelf panel is supported as in the previously described embodiment, except that in this embodiment the upper support member is rotated upwardly to insert a glass shelf panel 116.

Adjustment screw 52 is then rotated to draw upper support member 124 into contact with panel 116. Additional rotation of the adjustment screw will clamp the panel against compression pad 44 such that the panel cannot be removed.

Figure 3:
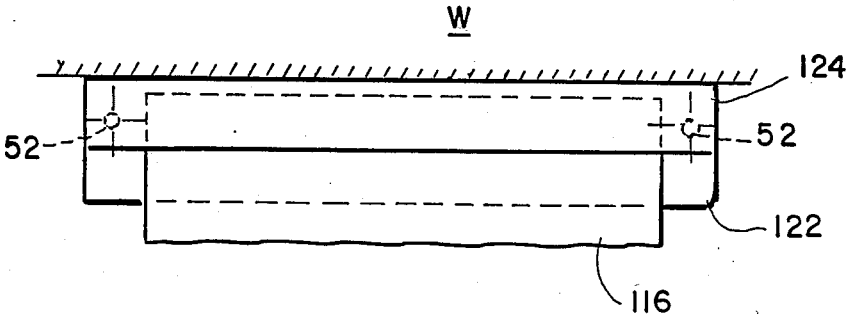
FIG. 3 is a top plan view of the shelf and bracket assembly shown in FIG. 2.

Referring now to FIG. 3, upper support member 124 and lower support platform 122 extend laterally a distance beyond the side edges of shelf panel 116. Adjustment screws 52 are disposed in this extension area so that they may extend from the lower support platform 122 to the upper support member 124 without penetrating the panel 116, which eliminates the need to provide openings in the panel for passage of the adjustment screws. Such openings may introduce additional areas of stress in the shelf panels.

Changes and modifications in the specifically described embodiments can be carried out without departing from the scope of the invention which is intended to be limited only by the scope of the appended claims.

The embodiments of the invention in which an exclusive property or privilege is claimed are defined as follows:

1. A cantilever shelf support bracket having a laterally oriented throat for receiving a rear portion of a shelf comprising:

a lower support member forming a throat bottom;

an upper support member forming a throat top;

a vertical bracket mounting plate forming a throat inner end;

lower connecting means for joining said lower support member to said mounting plate;

upper connecting means for joining said upper support member to said mounting plate;

said lower connecting means being a hinge member rotatable about a horizontal transverse axis, said upper connecting means being rigid;

said hinge member being a reduced thickness portion of said one of said lower and upper connecting means;

a lower support platform rigidly attached to said mounting plate;

said lower support platform extending from said mounting plate behind said lower support member and terminating in an outer support means for supporting an inserted shelf; and adjusting means between said lower support platform and said lower support member for rotatably adjusting said lower support member about said lower connecting means.

2. The shelf support bracket in claim 1 further comprising a resilient compression pad on an upper surface of said lower support member for supporting abutment with an inserted shelf.

3. The self support bracket in claim 1 wherein said adjusting means comprises an adjustment screw longitudinally adjustably retained in a threaded aperture in said lower support platform below said lower support member.

4. The self support bracket in claim 1 wherein said outer support means defines an upwardly extending, downwardly curved support surface.

5. A cantilever shelf support bracket having a laterally oriented throat for receiving a rear portion of a shelf comprising:

a lower support member forming a throat bottom;

an upper support member forming a throat top;

a vertical bracket mounting plate forming a throat inner end;

lower connecting means for joining said lower support member to said mounting plate;

upper connecting means for joining said upper support member to said mounting plate;

one of said lower and upper connecting means being a hinge member rotatable about a horizontal transverse axis, the other of said lower and upper connecting means being rigid;

adjusting menas for rotatably adjusting said one connecting means;

said upper connecting means being said hinge member; and said adjusting means comprising an adjustment screw means extending between said lower support member and said upper support member for biasing said members toward each other.

6. The shelf support bracket in claim 5 wherein said adjustment screw means comprises an adjustment screw extending through a clearance hole in said lower support member and engaged with a threaded hole in said upper support member.

7. The shelf support bracket in claim 5 wherein said lower support member extends from said mounting plate beyond said lower support member and terminates in an outer support means for supporting an inserted shelf.

8. The shelf support bracket in claim 7 wherein said outer support means defines an upwardly extending, downwardly curved support surface.

9. The shelf support bracket in claim 5 wherein said upper and lower support members extend laterally a distance greater than the length of an inserted shelf defining an extension portion of each of said support members beyond a side portion of an inserted shelf and wherein said adjustment screw means is extending between said extended portion of each of said support members.

10. A cantilever shelf support for a shelf having a rear portion comprising:

a bracket having a laterally oriented throat to receive the rear portion of a shelf;

said throat having a lower support platform defining a bottom, an upper support member defining an upper support surface and a panel forming an inner end;

a lower support member extending horizontally from said panel in said throat and defining a lower support surface;

flexible connecting means for flexibly connecting said lower support member to said panel; and adjusting means between said lower support member and said lower support platform for selectively adjusting the distance between said upper and said lower support surfaces.

11. The shelf support in claim 10 wherein said flexible connecting means comprises a reduced thickness portion of said lower support member.

12. A cantilever shelf support for a shelf having a rear portion comprising:

a bracket having a laterally oriented throat to receive the rear portion of a shelf;

said throat having a lower support platform defining a bottom, an upper support member defining an upper support surface and a panel forming an inner end;

rigid connecting means for connecting said lower support platform to said panel;

flexible connecting means for connecting said upper support member to said panel; and adjusting means between said upper support member and said lower support platform for adjusting the distance therebetween.

13. The shelf suport in claim 12 further having a resilient compression pad on said lower support surface forming a lower support surface for an inserted shelf.

14. The shelf support in claim 12 wherein said upper support member and said lower support platform extend laterally a distance greater than the length of an inserted shelf defining an extension portion beyond an inserted shelf lateral extent, wherein said adjusting means is in said extension portion.

* * * * *